US010273885B2

(12) United States Patent
Hirata

(10) Patent No.: US 10,273,885 B2
(45) Date of Patent: Apr. 30, 2019

(54) HIGH-PRESSURE PUMP CONTROL DEVICE FOR INTERNAL-COMBUSTION ENGINE

(71) Applicant: DENSO CORPORATION, Kariya, Aichi-pref. (JP)

(72) Inventor: Yasuo Hirata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/571,960

(22) PCT Filed: May 7, 2016

(86) PCT No.: PCT/JP2016/002252

§ 371 (c)(1),
(2) Date: Nov. 6, 2017

(87) PCT Pub. No.: WO2016/189803

PCT Pub. Date: Dec. 1, 2016

(65) Prior Publication Data

US 2018/0128188 A1 May 10, 2018

(30) Foreign Application Priority Data

May 26, 2015 (JP) ..... 2015-106221

(51) Int. Cl.
*F02D 1/06* (2006.01)
*F02M 51/04* (2006.01)
(Continued)

(52) U.S. Cl.
CPC ..... *F02D 1/06* (2013.01); *F02D 41/3845* (2013.01); *F02D 41/3854* (2013.01);
(Continued)

(58) Field of Classification Search
CPC ..... F02D 1/06; F02D 1/00; F02D 41/3854; F02D 41/3845; F02D 2041/142;
(Continued)

(56) References Cited

U.S. PATENT DOCUMENTS 6,125,832 A * 10/2000 Toyohara ..... F02D 11/105 123/479
6,499,456 B1 * 12/2002 Nogi ..... F02B 1/12 123/295
2002/0117150 A1 * 8/2002 Sykes ..... F02D 31/001 123/458
2005/0193981 A1 * 9/2005 Sakai ..... F02D 41/3094 123/431
(Continued)

FOREIGN PATENT DOCUMENTS

JP 9-119363 5/1997
JP 11-210540 8/1999
(Continued)

*Primary Examiner* — Joseph J Dallo
(74) *Attorney, Agent, or Firm* — Nixon & Vanderhye P.C.

(57) ABSTRACT

A high-pressure pump control device is applied to an internal combustion engine including a high-pressure pump supplied with fuel discharged from a low-pressure pump and an injector supplied with fuel discharged from the high-pressure pump. The high-pressure pump control device includes a prediction unit predicting whether a discharge quantity of the high-pressure pump exceeds a discharge quantity of the low-pressure pump and a restricting unit executing a discharge quantity restriction control to restrict a discharge quantity of the high-pressure pump not to exceed a predetermined value when the prediction unit predicts that a discharge quantity of the high-pressure pump exceeds a discharge quantity of the low-pressure pump.

12 Claims, 10 Drawing Sheets

(51) Int. Cl.

| | |
|---|---|
| ***F02M 59/36*** | (2006.01) |
| ***F02D 41/38*** | (2006.01) |
| *F02D 1/00* | (2006.01) |
| *F02D 41/14* | (2006.01) |

(52) U.S. Cl.
CPC ..... *F02M 51/04* (2013.01); *F02M 59/36* (2013.01); *F02D 2001/009* (2013.01); *F02D 2041/142* (2013.01); *F02D 2041/1412* (2013.01); *F02D 2200/0602* (2013.01); *F02D 2250/31* (2013.01)

(58) Field of Classification Search
CPC ..... F02D 2200/0602; F02D 2250/31; F02D 2041/1412; F02D 2001/009; F02M 59/36; F02M 51/04
See application file for complete search history.

(56) References Cited

U.S. PATENT DOCUMENTS

| | | | | |
|---|---|---|---|---|
| 2006/0266327 | A1* | 11/2006 | Fukasawa | F02D 41/3845 123/305 |
| 2010/0274467 | A1* | 10/2010 | Hayami | F02D 41/2438 701/103 |
| 2017/0211503 | A1* | 7/2017 | Tachibana | F02D 41/34 |

FOREIGN PATENT DOCUMENTS

| | | | | |
|---|---|---|---|---|
| JP | 2005-155415 | | 6/2005 | |
| JP | 2007-92660 | | 4/2007 | |
| JP | 2008-121563 | | 5/2008 | |
| JP | 2008-303853 | | 12/2008 | |
| JP | 2009-79564 | | 4/2009 | |
| JP | 2010255501 | A * | 11/2010 | F02D 41/2438 |

* cited by examiner

FUEL PRESSURE CONTROL

| | | 300 | 1000 | 2000 | 3000 | 4000 | 5000 | 6000 |
|---|---|---|---|---|---|---|---|---|
| TARGET FUEL PRESSURE [MPa] | 4 | 5.76 | 5.86 | 5.87 | 5.93 | 5.84 | 5.69 | 5.16 |
| | 12 | 5.36 | 5.41 | 5.51 | 5.60 | 5.57 | 5.36 | 4.97 |
| | 20 | 4.46 | 5.15 | 5.23 | 5.32 | 5.40 | 5.15 | 4.77 |

| | 300 | 1000 | 2000 | 3000 | 4000 | 5000 | 6000 |
|---|---|---|---|---|---|---|---|
| 0 | 20.0 | 20.0 | 20.0 | 20.0 | 20.0 | 20.0 | 20.0 |
| 50 | 20.0 | 20.0 | 20.0 | 20.0 | 17.5 | 15.0 | 12.5 |
| 100 | 20.0 | 20.0 | 20.0 | 20.0 | 15.0 | 10.0 | 5.0 |

| | 300 | 1000 | 2000 | 3000 | 4000 | 5000 | 6000 |
|---|---|---|---|---|---|---|---|
| 0 | 20.0 | 20.0 | 20.0 | 20.0 | 20.0 | 20.0 | 20.0 |
| 50 | 20.0 | 20.0 | 20.0 | 20.0 | 17.5 | 15.0 | 12.5 |
| 100 | 20.0 | 20.0 | 20.0 | 20.0 | 15.0 | 10.0 | 5.0 |

HIGH-PRESSURE PUMP CONTROL DEVICE FOR INTERNAL-COMBUSTION ENGINE

CROSS REFERENCE TO RELATED APPLICATION

This application is the U.S. national phase of International Application No. PCT/JP2016/002252 filed May 7, 2016, which designated the U.S. and claims priority to Japanese Patent Application No. 2015-106221 filed on May 26, 2015, the entire contents of each of which are hereby incorporated herein by reference.

TECHNICAL FIELD

The present disclosure relates to a high-pressure pump control device applied to an internal combustion engine which supplies an injector with fuel discharged from a high-pressure pump.

BACKGROUND ART

In an in-cylinder injection internal combustion engine configured to inject fuel directly into a cylinder, a time from injection to combustion is short in comparison with an intake port injection internal combustion engine configured to inject fuel to an intake port. Hence, a time secured to atomize injected fuel is so short that it is necessary to turn injected fuel to fine particles by increasing an injection pressure to a high pressure. Accordingly, in the in-cylinder injection internal combustion engine, fuel pumped up from a fuel tank using an electric low-pressure pump is supplied to a high-pressure pump driven by power of the internal combustion engine, and high-pressure fuel discharged from the high-pressure pump is pressure-fed to an injector.

Generally, the in-cylinder injection internal combustion engine is provided with a fuel pressure sensor detecting a pressure of fuel (fuel pressure) supplied to the injector. A target fuel pressure is set according to an operating state of the internal combustion engine and a discharge quantity of the high-pressure pump is controlled by feedback in such a manner that an actual fuel pressure detected by the fuel pressure sensor coincides with the target fuel pressure.

In the in-cylinder injection internal combustion engine as above, a discharge quantity of the low-pressure pump is varied according to an operating state of the internal combustion engine as is described in Patent Literature 1. Hence, a discharge quantity of the low-pressure pump is restricted from becoming excessive for fuel consumption (that is, a fuel injection quantity) by varying a discharge quantity of the low-pressure pump in response to fuel consumption that varies with an operating state of the internal combustion engine. Wasteful power consumption by the low-pressure pump is thus restricted.

PRIOR ART LITERATURES

Patent Literature

Patent Literature 1: JP2008-121563A

SUMMARY OF INVENTION

In the in-cylinder injection internal combustion engine, the target fuel pressure tends to be set to a higher fuel pressure as a rotation speed and a load of the internal combustion engine are increased with an aim of increasing a dynamic range of the injector and improving atomization of injected fuel. Meanwhile, the low-pressure pump tends to reduce a margin of discharge performance with an aim of saving energy and restricting a rise in fuel temperature (that is, reducing an evaporation gas). Hence, a discharge quantity of the high-pressure pump may temporarily exceed a discharge quantity of the low-pressure pump, for example, in a process of fuel pressure rising when transition from a low-load low-fuel pressure state to a high-load high-fuel pressure state is taking place while the internal combustion engine is rotating at a high speed due to an increase in fuel consumption for a high load or an increase in fuel consumption for raising a pressure. When a discharge quantity of the high-pressure pump exceeds a discharge quantity of the low-pressure pump, a pressure of fuel supplied to the high-pressure pump decreases, in which case cavitation erosion (that is, damage caused when air bubbles are formed and burst) occurs inside the high-pressure pump when a fuel temperature is high. Hence, the high-pressure pump is likely to have a shorter life.

An object of the present disclosure is to provide a high-pressure pump control device applied to an internal combustion engine which can extend a life of a high-pressure pump by preventing or restricting cavitation erosion occurring inside the high-pressure pump.

According to an aspect of the present disclosure, the high-pressure pump control device is applied to the internal combustion engine including a high-pressure pump supplied with fuel discharged from a low-pressure pump and an injector supplied with fuel discharged from the high-pressure pump. The high-pressure pump control device includes a prediction unit predicting whether a discharge quantity of the high-pressure pump exceeds a discharge quantity of the low-pressure pump and a restricting unit executing a discharge quantity restriction control to restrict a discharge quantity of the high-pressure pump not to exceed a predetermined value when the prediction unit predicts that a discharge quantity of the high-pressure pump exceeds a discharge quantity of the low-pressure pump.

According to the configuration as above, when it is predicted that a discharge quantity of the high-pressure pump exceeds a discharge quantity of the low-pressure pump, a discharge quantity of the high-pressure pump can be restricted not to exceed a predetermined value by executing the discharge quantity restriction control. Hence, cavitation erosion occurring inside the high-pressure pump can be prevented or restricted by preventing or restricting a discharge quantity of the high-pressure pump from exceeding a discharge quantity of the low-pressure pump. Consequently, a life of the high-pressure pump can be extended.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Hereinafter, the present disclosure will be described by some specific embodiments.

First Embodiment

A first embodiment of the present disclosure will now be described according to FIG. 1 to FIG. 6.

Firstly, a schematic configuration of a fuel supply system of an in-cylinder injection engine (internal combustion engine) will be described according to FIG. 1 and FIG. 2.

Figure 1:
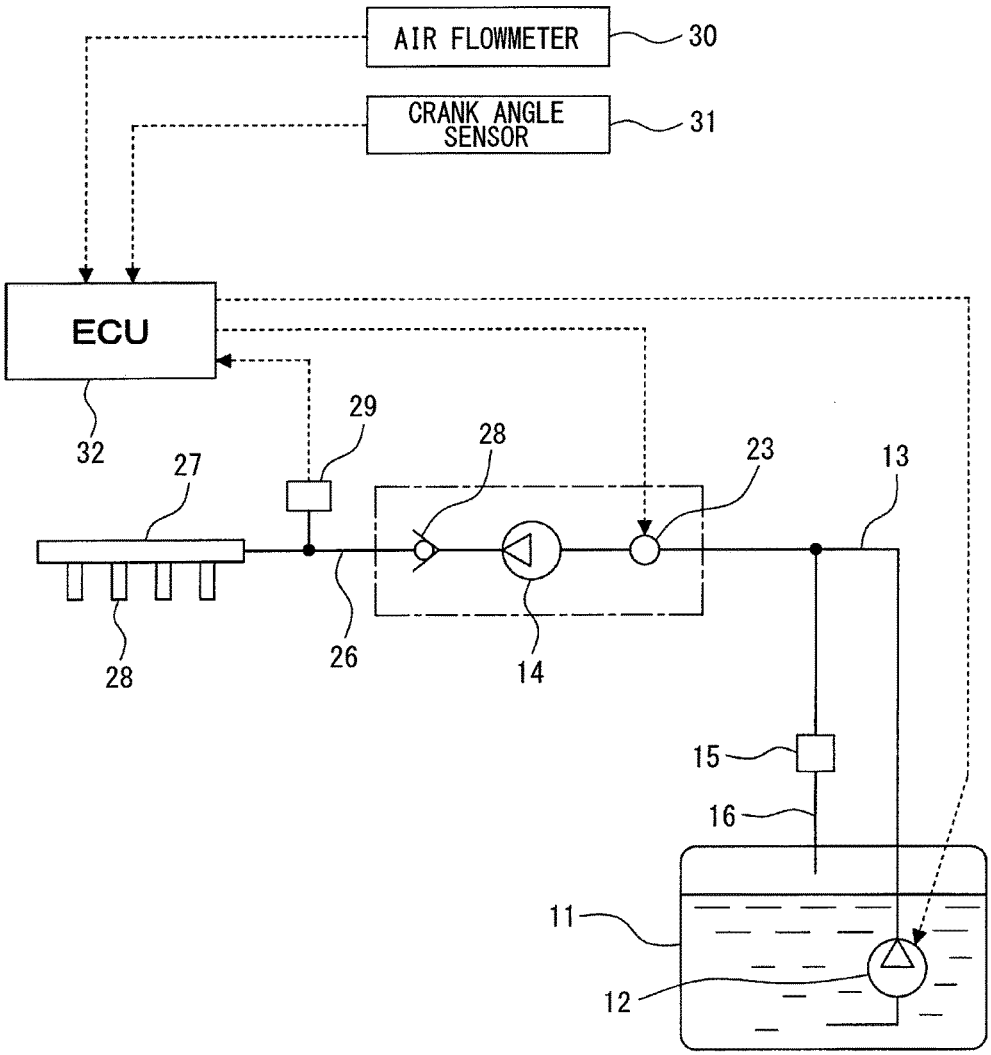
FIG. 1 is a view showing a schematic configuration of a fuel supply system according to a first embodiment of the present disclosure.

As is shown in FIG. 1, a low-pressure pump 12 pumping up fuel is provided in a fuel tank 11 where fuel is stored. The low-pressure pump 12 is driven by an electric motor (not shown) using a battery (not shown) as a power supply. Fuel discharged from the low-pressure pump 12 is supplied to a high-pressure pump 14 through a fuel pipe 13. A pressure regulator 15 is connected to the fuel pipe 13. A discharge pressure (that is, a fuel supply pressure to the high-pressure pump 14) of the low-pressure pump 12 is regulated at a predetermined pressure by the pressure regulator 15. Excessive fuel exceeding the predetermined pressure is returned to the fuel tank 11 through a fuel returning pipe 16.

Figure 2:
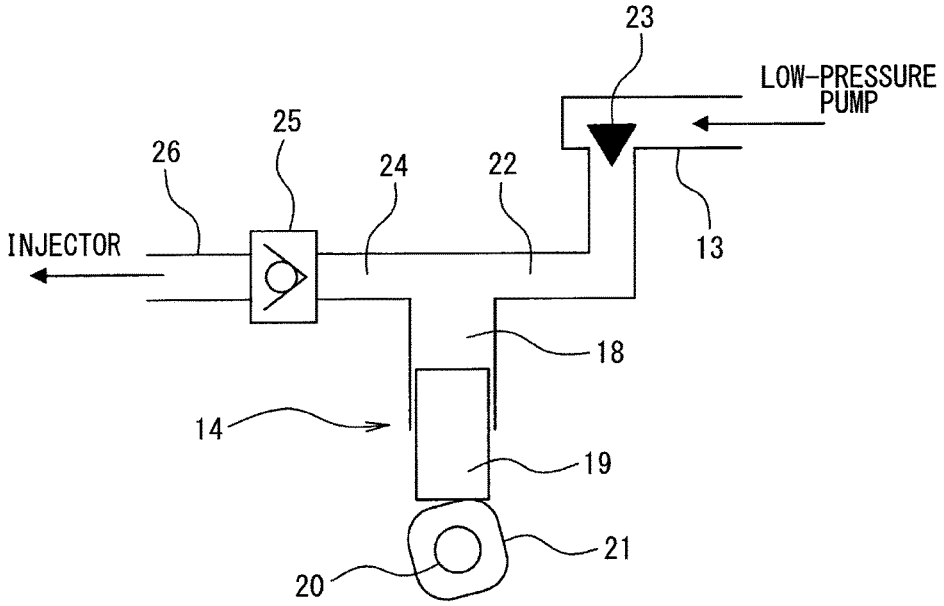
FIG. 2 is a view showing a schematic configuration of a high-pressure pump.

As is shown in FIG. 2, the high-pressure pump 14 is a plunger pump which draws in and discharges fuel by allowing a plunger 19 to reciprocate in a pump chamber 18 that is a cylindrical shape. The plunger 19 is driven by rotational motion of a cam 21 fit around a cam shaft 20 of the engine. A fuel pressure control valve 23 having a normally-open electromagnetic valve is provided on a side of an intake port 22 of the high-pressure pump 14.

The fuel pressure control valve 23 is energized under control in such a manner that the fuel pressure control valve 23 opens and fuel is drawn into the pump chamber 18 in an intake stroke of the high-pressure pump 14 (when the plunger 19 moves downward), whereas the fuel pressure control valve 23 closes and fuel in the pump chamber 18 is discharged in a discharge stroke of the high-pressure pump 14 (when the plunger 19 moves upward).

A fuel pressure (pressure of fuel) is controlled by controlling a discharge quantity of the high-pressure pump 14 by controlling a valve-closing period of the fuel pressure control valve 23 by controlling energization start timing of the fuel pressure control valve 23. For example, when a fuel pressure is raised, a discharge quantity of the high-pressure pump 14 is increased by extending a valve-closing period of the fuel pressure control valve 23 by advancing the valve-closing start timing of the fuel pressure control valve 23 by advancing energization start timing of the fuel pressure control valve 23. Conversely, when a fuel pressure is lowered, a discharge quantity of the high-pressure pump 14 is reduced by shortening the valve-closing period of the fuel pressure control valve 23 by lagging the valve-closing start timing of the fuel pressure control valve 23 by lagging energization start timing of the fuel pressure control valve 23.

Meanwhile, a check valve 25 preventing a backflow of discharged fuel is provided on a side of a discharge port 24 of the high-pressure pump 14. As is shown in FIG. 1, high-pressure fuel discharged from the high-pressure pump 14 is sent to a delivery pipe 27 through a high-pressure fuel pipe 26 and distributed to injectors 28 attached to respective cylinders of the engine from the delivery pipe 27. The injector 28 is an in-cylinder injector which injects fuel directly into the cylinder.

A fuel pressure sensor 29 detecting a fuel pressure in a high-pressure fuel passage, such as the high-pressure fuel pipe 26 and the delivery pipe 27, is provided to the high-pressure fuel pipe 26 (or the delivery pipe 27). The delivery pipe 27 may be provided with a relief valve (not shown) which opens when a fuel pressure in the high-pressure fuel passage rises above a predetermined upper-limit value to connect an exhaust port of the relief valve to the fuel tank 11 (or the fuel pipe 13 on a low-pressure side) via a relief pipe.

The engine is provided with an air flowmeter 30 detecting an intake air quantity and a crank angle sensor 31 outputting a pulse signal for every predetermined crank angle in synchronization with a rotation of a crank shaft (not shown). A crank angle and an engine speed are detected according to an output signal of the crank angle sensor 31.

Outputs of the various sensors described above are inputted into an electronic control unit (ECU) 32. The ECU 32 is chiefly formed of a micro-computer and controls a fuel injection quantity, ignition timing, and a throttle opening degree (intake air quantity) according to an engine operating state by running various engine control programs pre-stored in an internal ROM (storage medium). In the present embodiment, the ECU 32 corresponds to a high-pressure pump control device for the internal combustion engine.

The ECU 32 functions also as a fuel pressure control unit and executes a fuel pressure control to control a fuel pressure by controlling a discharge quantity of the high-pressure pump 14 by controlling valve-closing start timing of the fuel pressure control valve 23 by controlling energization start timing of the fuel pressure control valve 23. The ECU 32 calculates an F/B control quantity according to a deviation of an actual fuel pressure detected by the fuel pressure sensor 29 from a target fuel pressure, and executes a fuel pressure F/B control to correct a discharge quantity of the high-pressure pump 14 by using the calculated F/B control quantity. Herein, "F/B" stands for feedback. Hence, the F/B control quantity is the feedback control quantity when written in a complete form.

Figure 3:
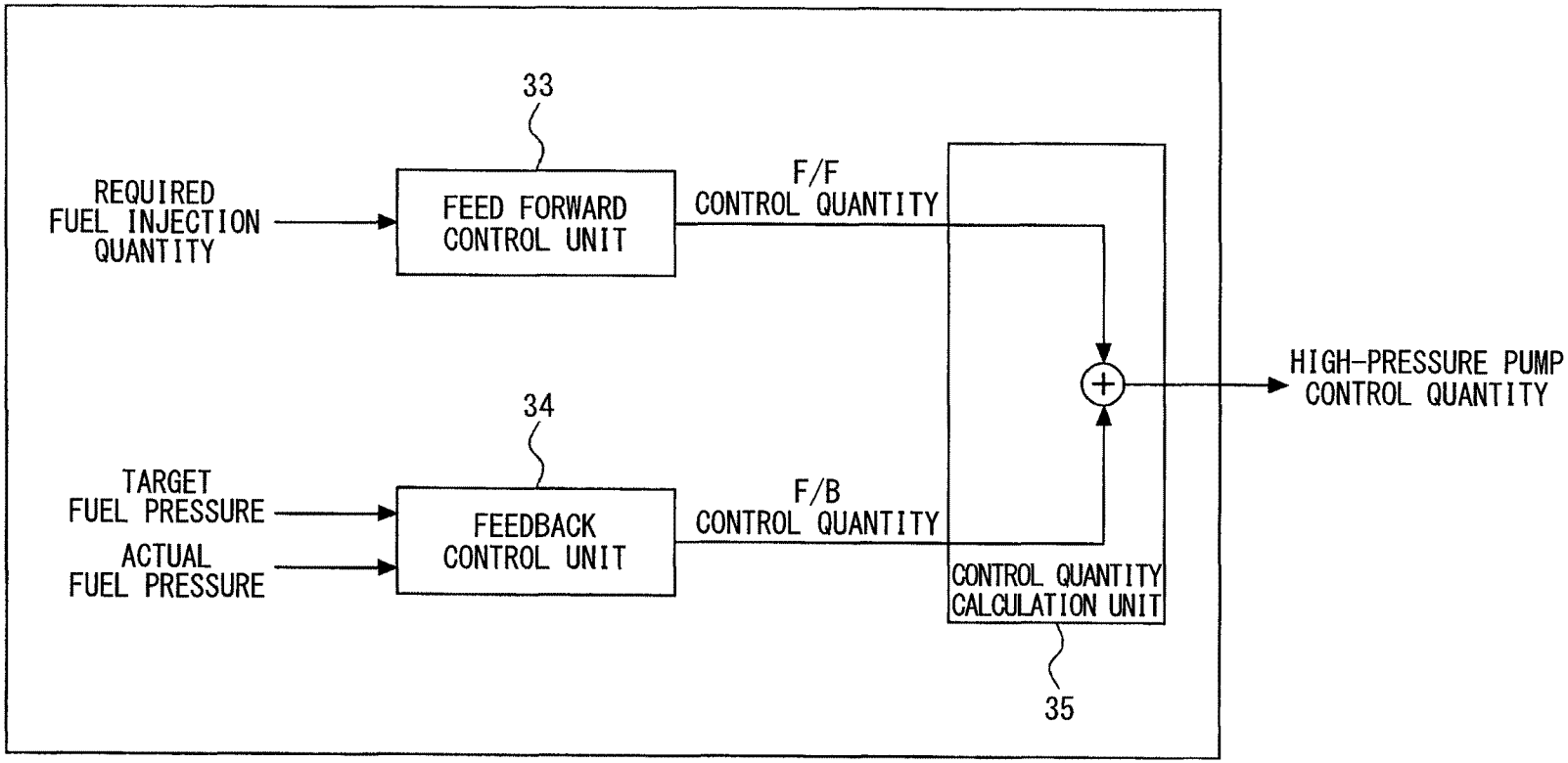
FIG. 3 is a block diagram schematically showing a fuel pressure control function of an ECU.

More specifically, as is shown in FIG. 3, the ECU 32 calculates a required fuel injection quantity according to an engine operating state (for example, an engine speed or an engine load) by using a map of the like. Subsequently, a feed forward control unit 33 calculates an F/F control quantity according to the required fuel injection quantity by using a map or the like. Herein, "F/F" stands for feed forward.

The ECU 32 also calculates a target fuel pressure according to an engine operating state (for example, an engine speed or an engine load) by using a map or the like and reads out an actual fuel pressure detected by the fuel pressure sensor 29. Subsequently, a feedback control unit 34 calculates a deviation of the actual fuel pressure from the target fuel pressure as a fuel pressure deviation and calculates an F/B control quantity according to the fuel pressure deviation by a PI control, a PID control, or the like. For example, in the PI control, the feedback control unit 34 calculates a proportional term by using the fuel pressure deviation and a proportional gain as well as an integral term by using the fuel pressure deviation and an integral gain, and calculates the F/B control quantity by using the proportional term and the integral term.

Subsequently, a control quantity calculation unit 35 calculates a control quantity of the high-pressure pump 14 (that is, energization start timing of the fuel pressure control valve 23) in accordance with Equation (1) below by using the F/F control quantity and the F/B control quantity.

high-pressure pump control quantity=*F/F* control quantity+*F/B* control quantity Equation (1)

When a discharge quantity of the high-pressure pump 14 exceeds a discharge quantity of the low-pressure pump 12, a pressure of fuel supplied to the high-pressure pump 14 decreases. In such a case, cavitation erosion (that is, damage caused when air bubbles are formed and burst) occurs inside the high-pressure pump 14 when a fuel temperature is high. Hence, the high-pressure pump 14 is likely to have a shorter life.

In order to prevent such an inconvenience, the ECU 32 executes a control as follows by executing a routine of FIG. 4. The ECU 32 predicts whether a discharge quantity of the high-pressure pump 14 exceeds a discharge quantity of the low-pressure pump 12. When it is predicted that a discharge quantity of the high-pressure pump 14 exceeds a discharge quantity of the low-pressure pump 12, the ECU 32 executes a discharge quantity restriction control to restrict a discharge quantity of the high-pressure pump 14 not to exceed a predetermined value (for example, a discharge quantity of the low-pressure pump 12). In the first embodiment, the ECU 32 executes the discharge quantity restriction control by restricting the F/B control quantity by restricting a proportional term of the F/B control quantity.

Figure 4:
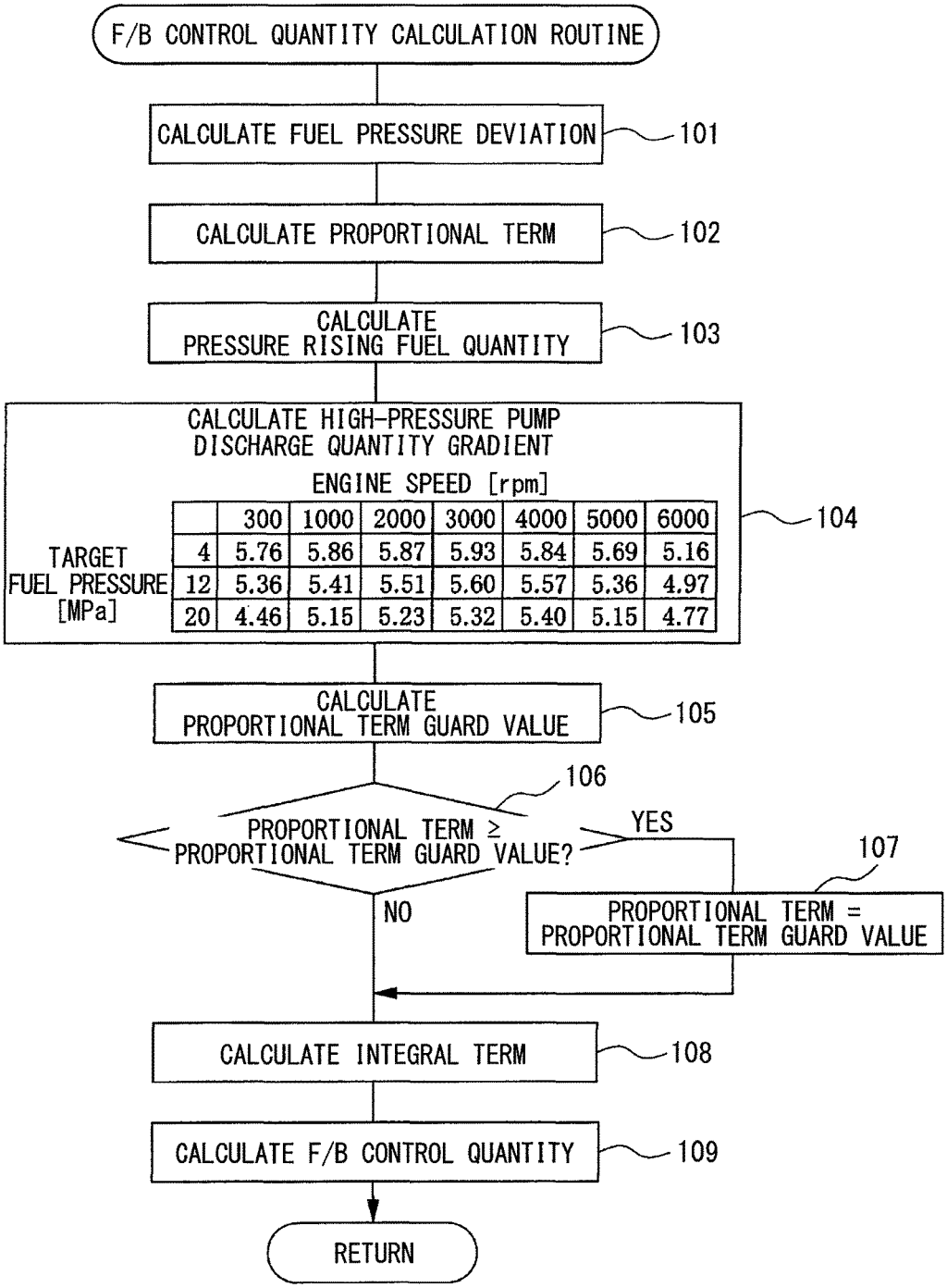
FIG. 4 is a flowchart depicting a processing flow of an F/B control quantity calculation routine of the first embodiment.

The following will describe a processing content of an F/B control quantity calculation routine of FIG. 4 executed by the ECU 32 in the first embodiment.

The F/B control quantity calculation routine shown in FIG. 4 is executed repetitively in predetermined cycles while the power supply of the ECU 32 is switched ON to function as a prediction unit and a restricting unit. When the routine is started, a deviation of an actual fuel pressure from the target fuel pressure is calculated as a fuel pressure deviation [MPa] in 101 in accordance with Equation (2) as follows.

fuel pressure deviation=target fuel pressure−actual fuel pressure Equation (2)

Subsequently, advancement is made to 102, in which a proportional term [° CA] is found by multiplying the fuel pressure deviation by a proportional gain as is expressed by Equation (3) as follows.

proportional term=fuel pressure deviation×proportional gain Equation (3)

Subsequently, advancement is made to 103, in which engine fuel consumption quantity per rotation [$mm^3$/str] is calculated according to an engine load (for example, an intake air quantity or an intake air pressure), and a difference between a low-pressure pump discharge quantity (for example, a maximum value) and the engine fuel consumption quantity is calculated as a pressure rising fuel quantity [$mm^3$/str] in accordance with Equation (4) as follows.

pressure rising fuel quantity=low-pressure pump discharge quantity−engine fuel consumption quantity Equation (4)

Subsequently, advancement is made to 104, in which a high-pressure pump discharge quantity gradient corresponding to an engine speed [rpm] and the target fuel pressure (or the actual fuel pressure) [MPa] is calculated with reference to a map of a high-pressure pump discharge quantity gradient [$mm^3$/° CA]. The map of the high-pressure pump discharge quantity gradient is preliminarily created according to test data, design data, and so on and pre-stored in the ROM of the ECU 32.

Subsequently, advancement is made to 105, in which a proportional term guard value [° CA] is found by dividing the pressure rising fuel quantity by the high-pressure pump discharge quantity gradient as is expressed by Equation (5) as follows.

proportional term guard value=pressure rising fuel quantity/high-pressure pump discharge quantity gradient Equation (5)

The proportional term guard value is set to a value corresponding to a proportional term, with which the F/B control quantity making a discharge quantity of the high-pressure pump 14 and a discharge quantity (for example, a maximum value) of the low-pressure pump 12 equal is calculated.

Subsequently, advancement is made to 106, in which a prediction is made as to whether a discharge quantity of the high-pressure pump 14 exceeds a discharge quantity of the low-pressure pump 12 depending on whether the proportional term calculated in 102 is equal to or greater than the proportional term guard value.

When it is determined in 106 that the proportional term is smaller than the proportional term guard value, it is predicted that a discharge quantity of the high-pressure pump 14 does not exceed a discharge quantity of the low-pressure pump 12. Hence, the proportional term calculated in 102 is adopted intact.

Meanwhile, when it is determined in 106 that the proportional term is equal to or greater than the proportional term guard value, it is predicted that a discharge quantity of the high-pressure pump 14 exceeds a discharge quantity of the low-pressure pump 12 unless a discharge quantity of the high-pressure pump 14 is restricted. Hence, advancement is made to 107, in which the proportional term is restricted with the proportional term guard value as is expressed by Equation (6) as follows.

proportional term=proportional term guard value Equation (6)

Subsequently, advancement is made to 108, in which an integral term [° CA] at a present time is calculated in accordance with Equation (7) below using the fuel pressure deviation, an integral gain, and a last integral term (i−1).

integral term=integral term(*i*−1)+fuel pressure deviation×integral gain Equation (7)

Subsequently, advancement is made to 109, in which an F/B control quantity [° CA] is calculated in accordance with Equation (8) below using the proportional term and the integral term, and the routine is ended.

*F/B* control quantity=proportional term+integral term Equation (8)

According to the processing as above, when it is predicted that a discharge quantity of the high-pressure pump 14 exceeds a discharge quantity of the low-pressure pump 12, the discharge quantity restriction control is executed by restricting the F/B control quantity by restricting the proportional term of the F/B control quantity with the proportional term guard value.

Figure 6:
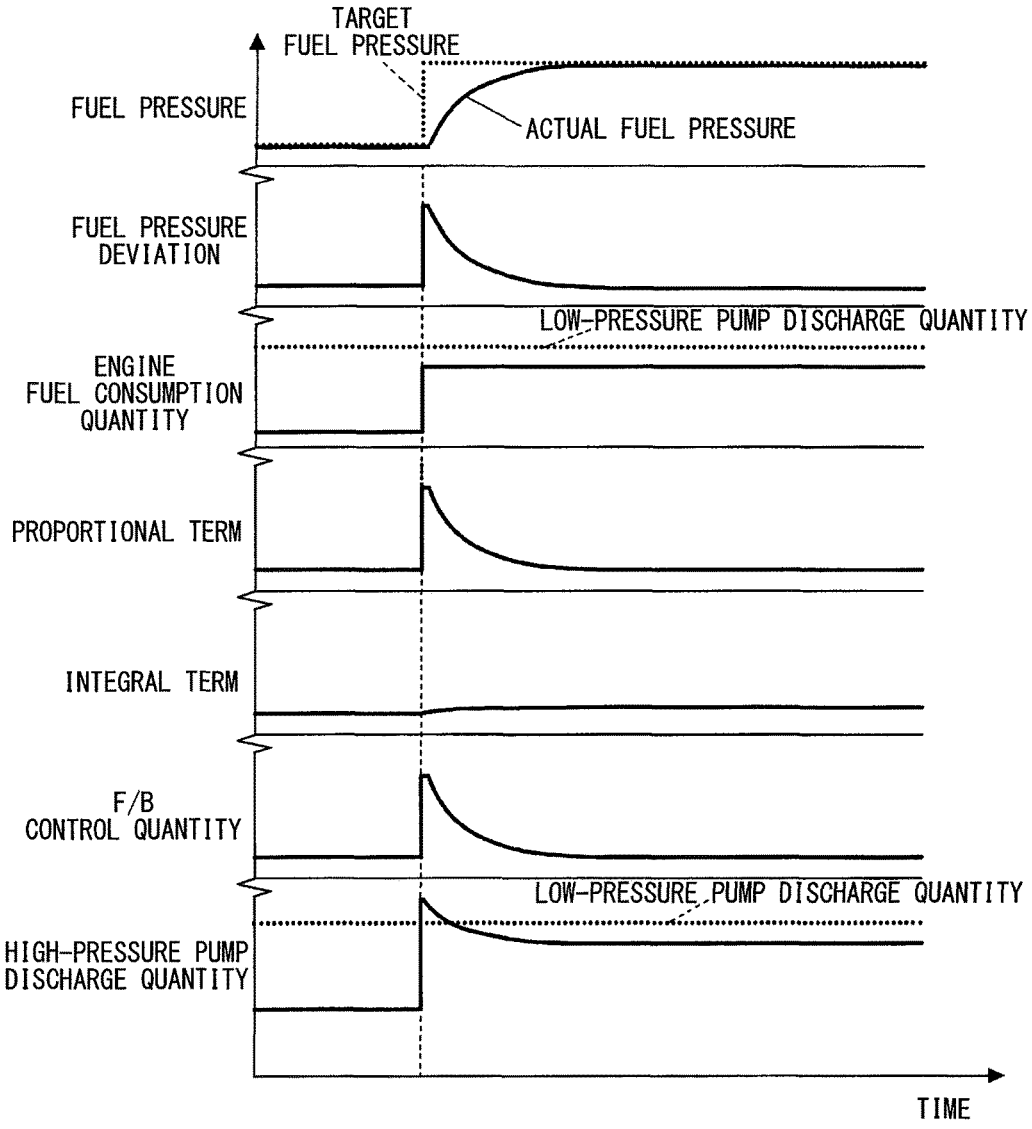
FIG. 6 is a time chart of a comparative example.

FIG. 6 shows a comparative example in which the discharge quantity restriction control is not executed. As is shown in the drawing, when engine fuel consumption quantity and the target fuel pressure are increased and the fuel pressure deviation increases with an increase in target fuel pressure, the proportional term and hence the F/B control quantity increase, too. Accordingly, a discharge quantity of the high-pressure pump 14 may increase significantly to an extent to temporarily exceed a discharge quantity of the low-pressure pump. When a discharge quantity of the high-pressure pump 14 exceeds a discharge quantity of the low-pressure pump 12, a pressure of fuel supplied to the high-pressure pump 14 decreases. In such a case, cavitation erosion occurs inside the high-pressure pump 14 when a fuel temperature is high. Hence, the high-pressure pump 14 is likely to have a shorter life.

Figure 5:
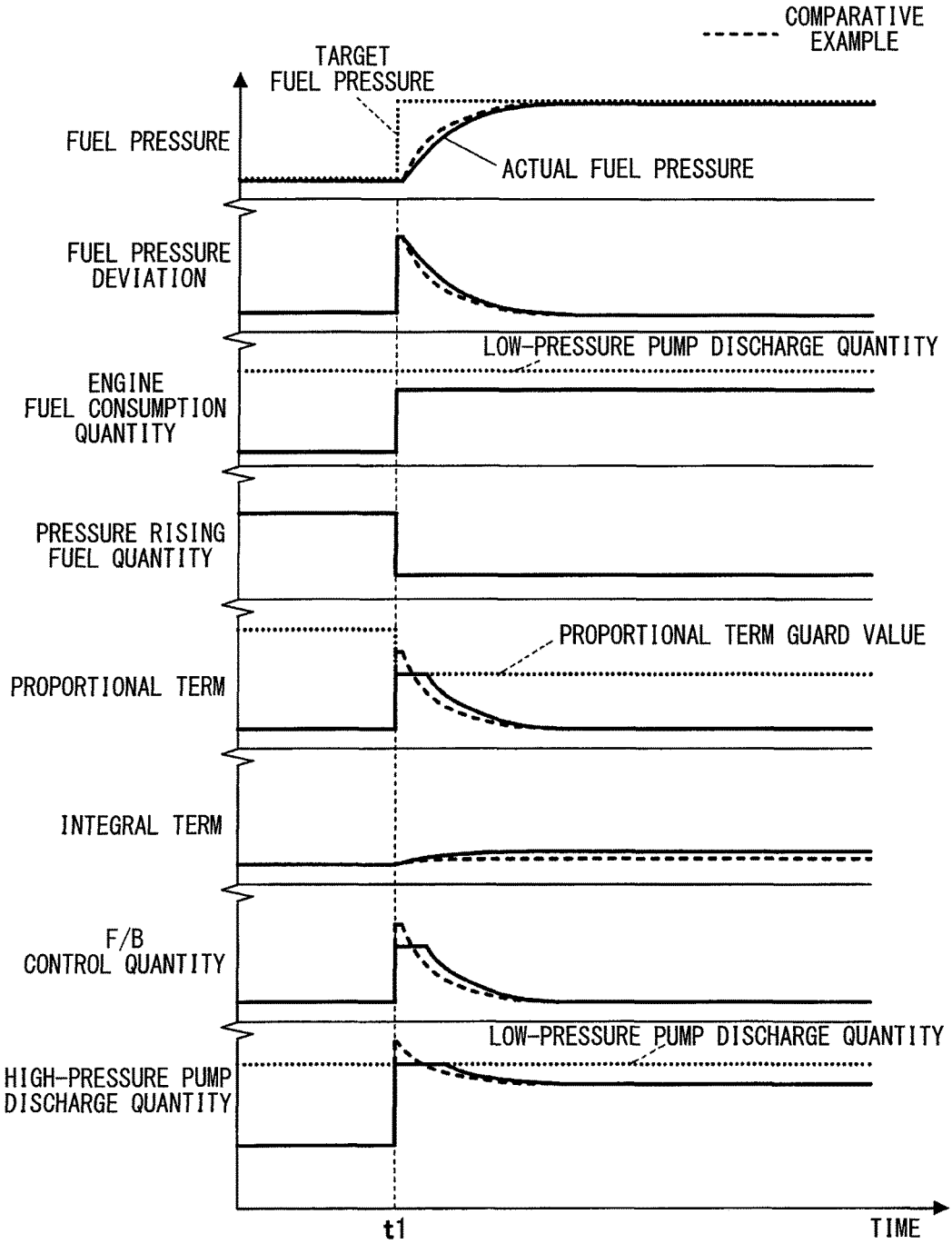
FIG. 5 is a time chart showing an execution example of a discharge quantity restriction control of the first embodiment.

In the first embodiment shown in FIG. 5, too, when engine fuel consumption quantity and the target fuel pressure are increased and the fuel pressure deviation increases with an increase of the target fuel pressure, the proportional term increases as well. However, in contrast to the comparative example, the F/B control quantity can be restricted by restricting the proportional term with the proportional term guard value by making a prediction that a discharge quantity of the high-pressure pump 14 exceeds a discharge quantity of the low-pressure pump 12 at a time t1 when the proportional term is determined to be equal to or greater than the proportional term guard value. Hence, the discharge quantity restriction control to restrict a discharge quantity of the high-pressure pump 14 not to exceed a discharge quantity of the low-pressure pump 12 can be executed, which can in turn prevent a discharge quantity of the high-pressure pump 14 from exceeding a discharge quantity of the low-pressure pump 12. Cavitation erosion occurring inside the high-pressure pump 14 can be thus prevented. Consequently, a life of the high-pressure pump 14 can be extended.

In the first embodiment, the discharge quantity restriction control is executed by restricting the F/B control quantity. In a system where a fuel pressure F/B control is executed, when a fuel pressure deviation increases with an increase in target fuel pressure, the F/B control quantity and hence a discharge quantity of the high-pressure pump 14 increase, too. Accordingly, by restricting the F/B control quantity, the discharge quantity restriction control can be executed by restricting a discharge quantity of the high-pressure pump 14 easily in a reliable manner.

Second Embodiment

A second embodiment of the present disclosure will now be described using FIG. 7 and FIG. 8. The following will chiefly describe a difference from the first embodiment above and portions substantially same as the portions of the first embodiment above will not be described repetitively or described only briefly.

Figure 7:
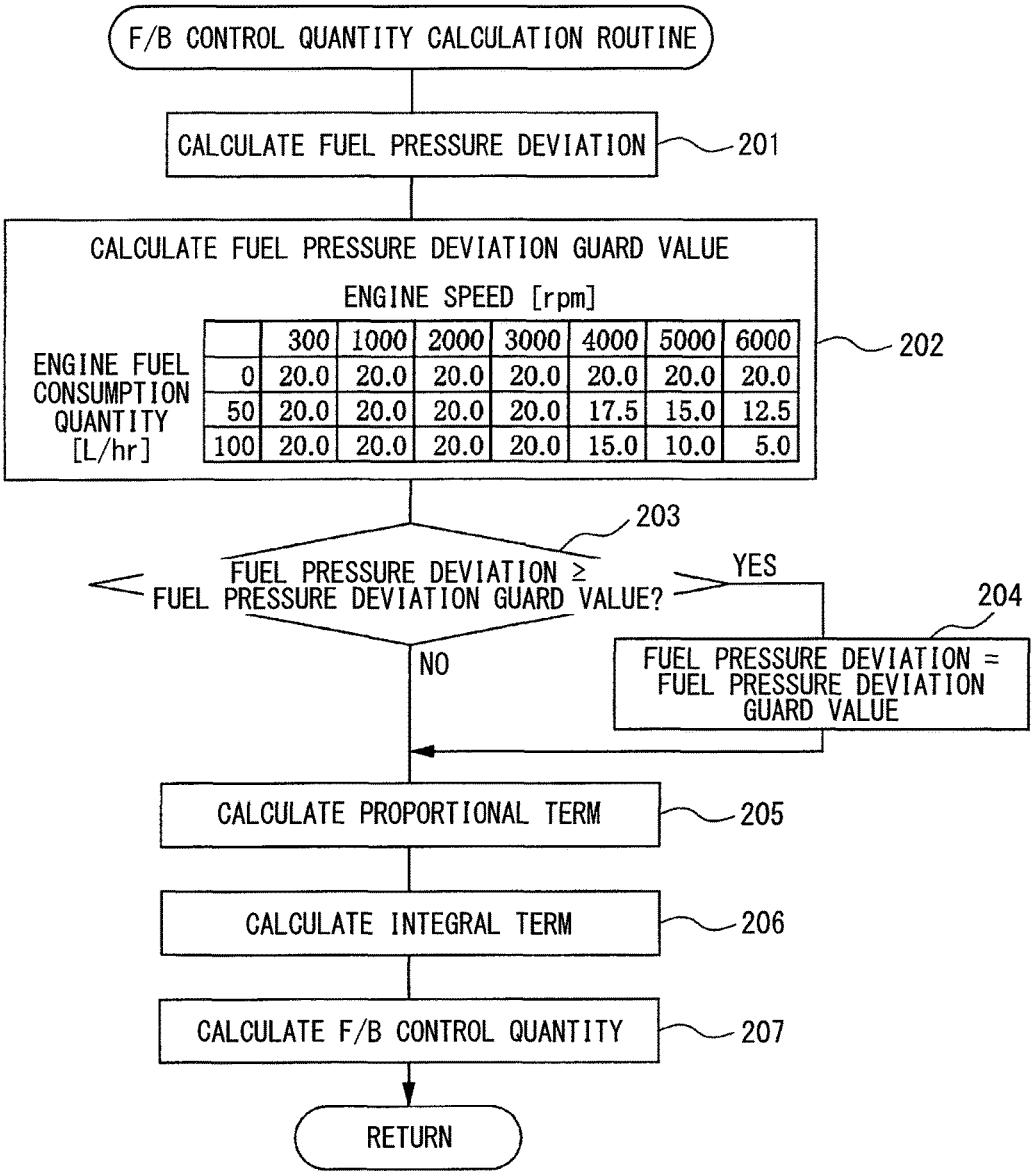
FIG. 7 is a flowchart depicting a processing flow of an F/B control quantity calculation routine of a second embodiment.

In the second embodiment, the ECU 32 executes an F/B control quantity calculation routine of FIG. 7 to execute a discharge quantity restriction control by restricting an F/B control quantity by restricting a fuel pressure deviation used to calculate the F/B control quantity.

In the F/B control quantity calculation routine of FIG. 7, a deviation of an actual fuel pressure from a target fuel pressure is calculated as a fuel pressure deviation [MPa] in 201 in accordance with Equation (2) above.

Subsequently, advancement is made to 202, in which engine fuel consumption quantity per hour [L/hr] is calculated according to an engine speed [rpm] and an engine load (for example, an intake air quantity or an intake air pressure), and a fuel pressure deviation guard value corresponding to the engine speed and the engine fuel consumption quantity is calculated with reference to a map of the fuel pressure deviation guard value [MPa]. The map of the fuel pressure deviation guard value is preliminary created according to test data, design data, and so on and pre-stored in a ROM of the ECU 32. The fuel pressure deviation guard value is set to a value corresponding to a fuel pressure deviation, with which an F/B control quantity making a discharge quantity of the high-pressure pump 14 and a discharge quantity (for example, a maximum value) of the low-pressure pump 12 equal is calculated.

Subsequently, advancement is made to 203, in which a prediction is made as to whether a discharge quantity of the high-pressure pump 14 exceeds a discharge quantity of the low-pressure pump 12 depending on whether the fuel pressure deviation calculated in 201 is equal to or greater than the fuel pressure deviation guard value.

When it is determined in 203 that the fuel pressure deviation is smaller than the fuel pressure deviation guard value, it is predicted that a discharge quantity of the high-pressure pump 14 does not exceed a discharge quantity of the low-pressure pump 12. Hence, the fuel pressure deviation calculated in 201 is adopted intact.

Meanwhile, when it is determined in 203 that the fuel pressure deviation is equal to or greater than the fuel pressure deviation guard value, it is predicted that a discharge quantity of the high-pressure pump 14 exceeds a discharge quantity of the low-pressure pump 12 unless a discharge quantity of the high-pressure pump 14 is restricted. Hence, advancement is made to 204, in which a fuel pressure deviation is restricted with the fuel pressure deviation guard value as is expressed by Equation (9) as follows.

$$\text{fuel pressure deviation} = \text{fuel pressure deviation guard value} \qquad \text{Equation (9)}$$

Subsequently, advancement is made to 205, in which a proportional term [° CA] is found by multiplying the fuel pressure deviation by a proportional gain as is expressed by Equation (3) above. Subsequently, advancement is made to 206, in which an integral term [° CA] at a present time is calculated in accordance with Equation (7) above using the fuel pressure deviation, an integral gain, and a last integral term (i−1).

Subsequently, advancement is made to 207, in which an F/B control quantity [° CA] is calculated in accordance with Equation (8) above using the proportional term and the integral term, and the routine is ended.

According to the processing described above, when it is predicted that a discharge quantity of the high-pressure pump 14 exceeds a discharge quantity of the low-pressure pump 12, the discharge quantity restriction control is executed by restricting an F/B control quantity by restricting a fuel pressure deviation used to calculate the F/B control quantity with the fuel pressure deviation guard value.

Figure 8:
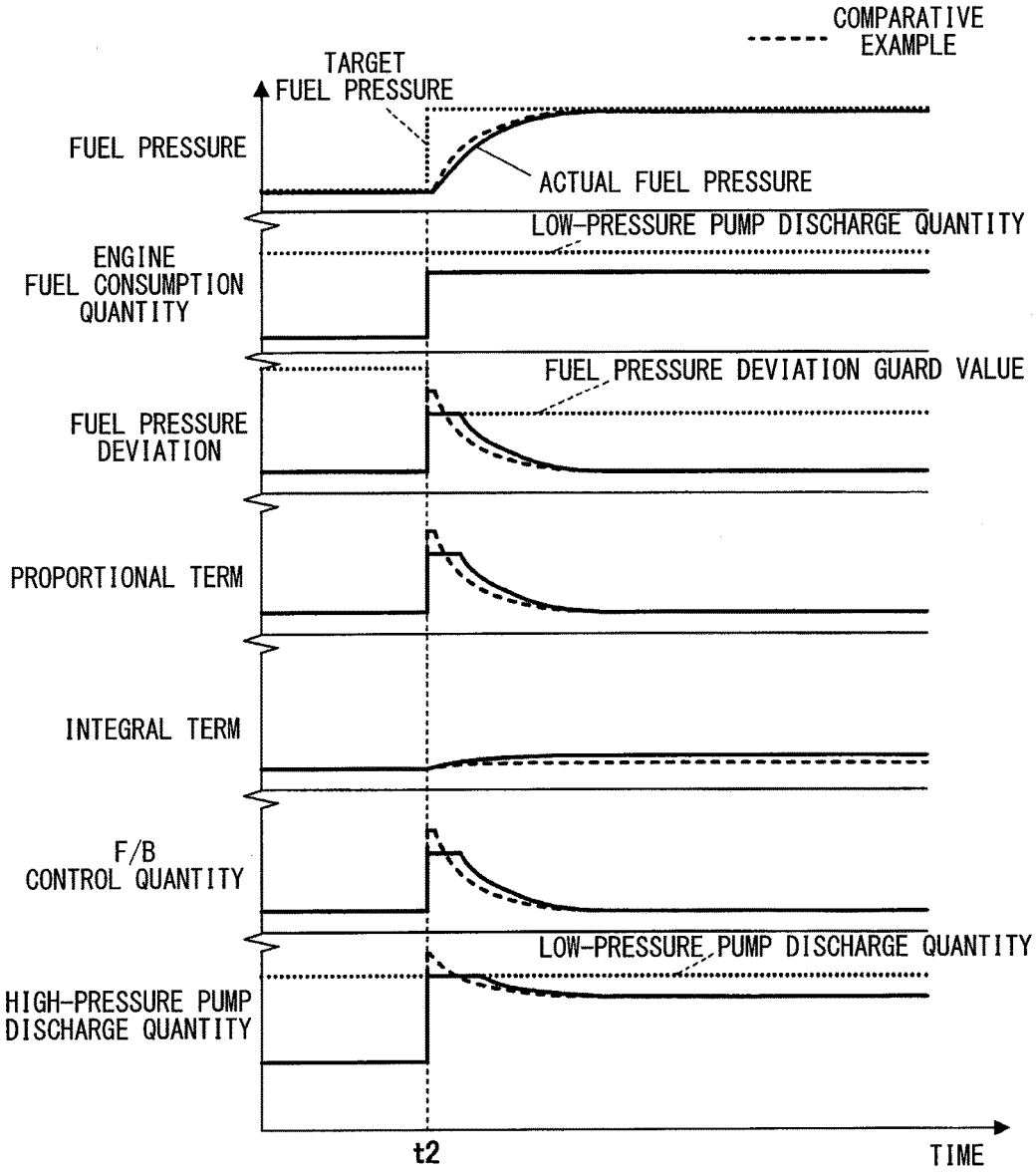
FIG. 8 is a time chart showing an execution example of a discharge quantity restriction control of the second embodiment.

In the second embodiment, as is shown in FIG. 8, when engine fuel consumption quantity and a target fuel pressure increase, a fuel pressure deviation increases with an increase in target fuel pressure. However, an F/B control quantity can be restricted by restricting a proportional term by restricting the fuel pressure deviation with the fuel pressure deviation guard value by making a prediction that a discharge quantity of the high-pressure pump 14 exceeds a discharge quantity of the low-pressure pump 12 at a time t2 when the fuel pressure deviation is determined to be equal to or greater than the fuel pressure deviation guard value. The discharge quantity restriction control to restrict a discharge quantity of the high-pressure pump 14 not to exceed a discharge quantity of the low-pressure pump 12 can be thus executed. Consequently, an effect substantially same as the effect of the first embodiment above can be achieved.

Third Embodiment

A third embodiment of the present disclosure will now be described using FIG. 9 and FIG. 10. The following will chiefly describe a difference from the first and second embodiments above and portions substantially same as the portions of the first and second embodiments above will not be described repetitively or described only briefly.

Figure 9:
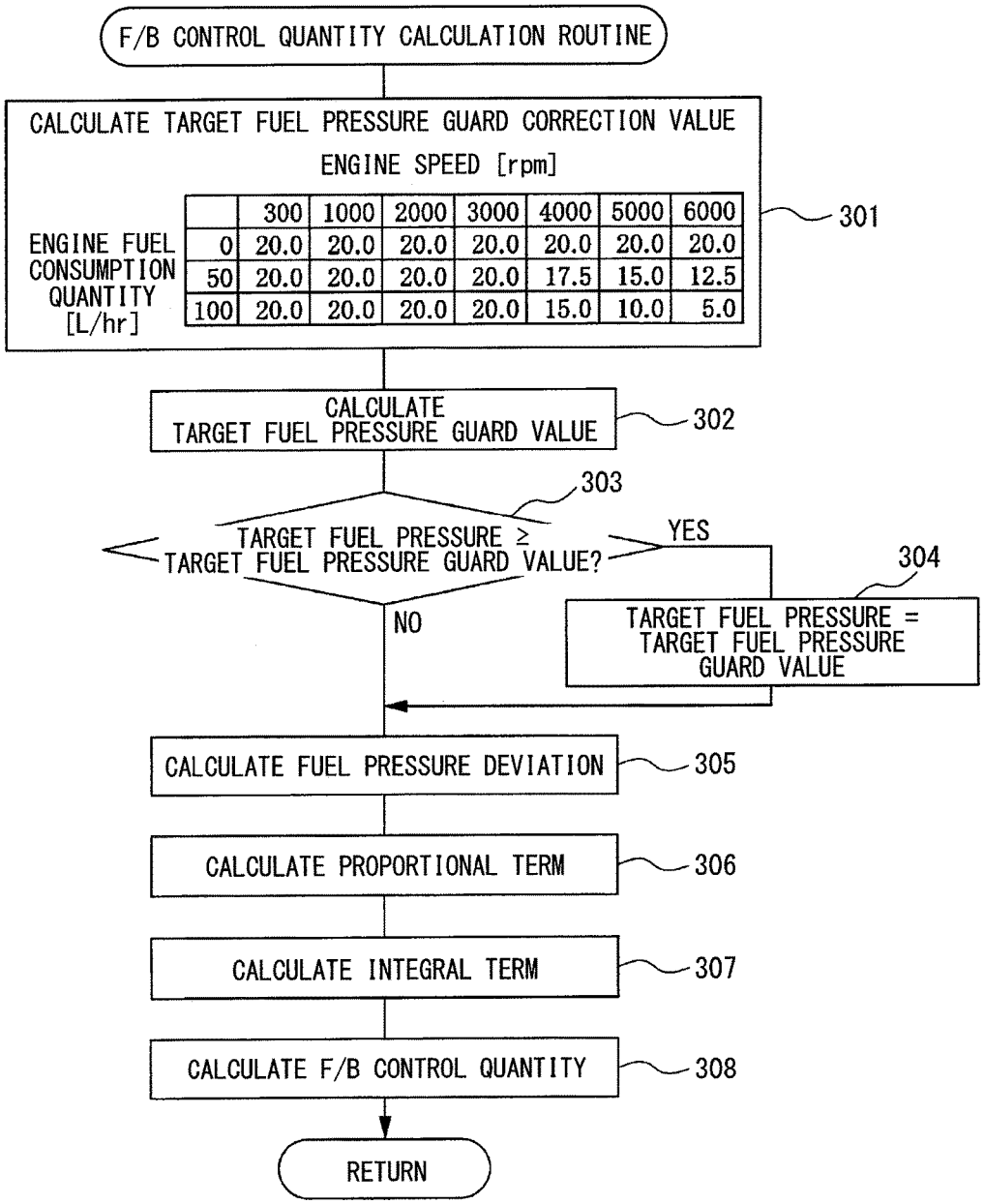
FIG. 9 is a flowchart depicting a processing flow of an F/B control quantity calculation routine of a third embodiment.

In the third embodiment, the ECU 32 executes an F/B control quantity calculation routine of FIG. 9 to perform a discharge quantity restriction control by restricting an F/B control quantity by restricting a target fuel pressure.

In the F/B control quantity calculation routine of FIG. 9, engine fuel consumption quantity per hour [L/hr] is calculated according to an engine speed [rpm] and an engine load (for example, an intake air quantity or an intake air pressure), and a target fuel pressure guard correction value corresponding to the engine speed and the engine fuel consumption quantity is calculated with reference to a map of a target fuel pressure guard correction value [MPa] in 301. The map of the target fuel pressure guard correction value is preliminarily created according to test data, design data, and so on and pre-stored in a ROM of the ECU 32.

Subsequently, advancement is made to 302, in which a target fuel pressure guard value [MPa] is found by adding the target fuel pressure guard correction value to an actual fuel pressure as is expressed by Equation (10) as follows.

$$\text{target fuel pressure guard value} = \text{actual fuel pressure} + \text{target fuel pressure guard correction value} \quad \text{Equation (10)}$$

The target fuel pressure guard value is set to a value corresponding to a target fuel pressure, with which an F/B control quantity making a discharge quantity of the high-pressure pump 14 and a discharge quantity (for example, a maximum value) of the low-pressure pump 12 equal is calculated.

Subsequently, advancement is made to 303, in which a prediction is made as to whether a discharge quantity of the high-pressure pump 14 exceeds a discharge quantity of the low-pressure pump 12 depending on whether the target fuel pressure is equal to or greater than the target fuel pressure guard value.

When it is determined in 303 that the target fuel pressure is smaller than the target fuel pressure guard value, it is predicted that a discharge quantity of the high-pressure pump 14 does not exceed a discharge quantity of the low-pressure pump 12 and a present target fuel pressure is adopted intact.

Meanwhile, when it is determined in 303 that the target fuel pressure is equal to or greater than the target fuel pressure guard value, it is predicted that a discharge quantity of the high-pressure pump 14 exceeds a discharge quantity of the low-pressure pump 12 unless a discharge quantity of the high-pressure pump 14 is restricted. Accordingly, advancement is made to 304, in which the target fuel pressure is restricted with the target fuel pressure guard value as is expressed by Equation (11) as follows.

$$\text{target fuel pressure} = \text{target fuel pressure guard value} \quad \text{Equation (11)}$$

Subsequently, advancement is made to 305, in which a deviation of an actual fuel pressure from the target fuel pressure is calculated as a fuel pressure deviation [MPa] in accordance with Equation (2) above.

Subsequently, advancement is made to 306, in which a proportional term [° CA] is found by multiplying the fuel pressure deviation by a proportional gain as is expressed by Equation (3) above. Subsequently, advancement is made to 307, in which an integral term [° CA] at a present time is calculated in accordance with Equation (7) above using the fuel pressure deviation, an integral gain, and a last integral term (i−1).

Subsequently, advancement is made to 308, in which an F/B control quantity [° CA] is calculated in accordance with Equation (8) above using the proportional term and the integral term, and the routine is ended.

According to the processing described above, when it is predicted that a discharge quantity of the high-pressure pump 14 exceeds a discharge quantity of the low-pressure pump 12, the discharge quantity restriction control is executed by restricting an F/B control quantity by restricting a target fuel pressure with the target fuel pressure guard value.

Figure 10:
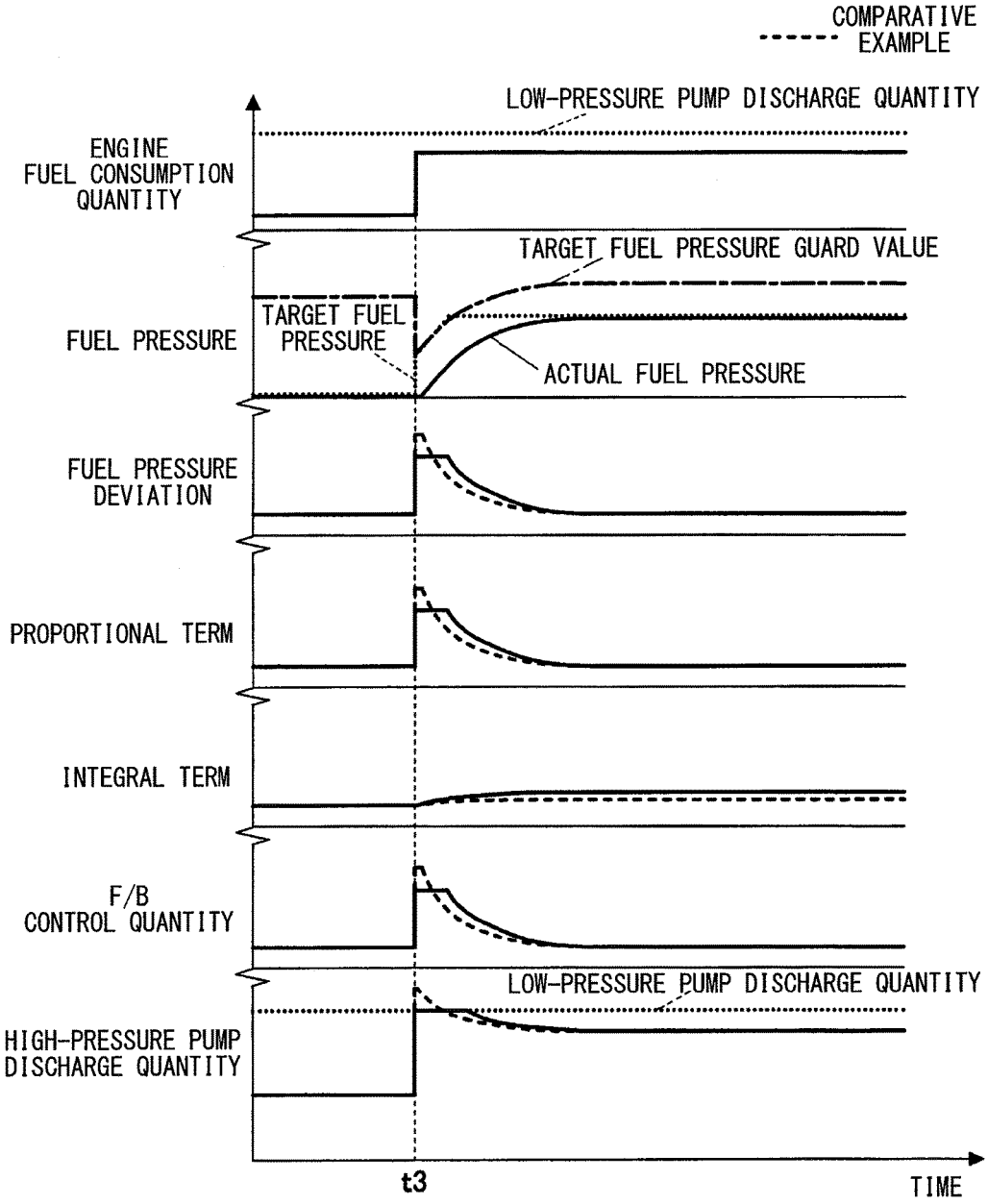
FIG. 10 is a time chart showing an execution example of a discharge quantity restriction control of the third embodiment.

In the third embodiment, as is shown in FIG. 10, when engine fuel consumption quantity and a target fuel pressure are increased, an F/B control quantity can be restricted by restricting a proportional term by restricting a fuel pressure deviation by restricting the target fuel pressure with the target fuel pressure guard value by making a prediction that a discharge quantity of the high-pressure pump 14 exceeds a discharge quantity of the low-pressure pump 12 at a time t3 when the target fuel pressure is determined to be equal to or greater than the target fuel pressure guard value. The discharge quantity restriction control to restrict a discharge quantity of the high-pressure pump 14 not to exceed a discharge quantity of the low-pressure pump 12 can be thus executed. Consequently, an effect substantially same as the effect of the first embodiment above can be achieved.

At least any two of the first to third embodiments above may be combined to perform the discharge quantity restriction control by restricting the F/B control quantity by restricting at least any two of the proportional term, the fuel pressure deviation, and the target fuel pressure with the corresponding guard values.

In the first to third embodiments above, the F/B control quantity is restricted indirectly by restricting, respectively, the proportional term, the fuel pressure deviation, and the target fuel pressure with the corresponding guard values. However, the discharge quantity restriction control may be executed by restricting the F/B control quantity with a guard value. Alternatively, the discharge quantity restriction control may be executed by restricting an F/F control quantity or a control quantity of the high-pressure pump 14 (that is, energization start timing of the fuel pressure control valve 23) with a corresponding guard value.

In the first to third embodiments above, a discharge quantity of the high-pressure pump 14 is restricted not to exceed a discharge quantity of the low-pressure pump 12 during the discharge quantity restriction control. However, the present disclosure is not limited to the restriction in the manner as above. For example, a discharge quantity of the high-pressure pump 14 may be restricted not to exceed a predetermined value slightly greater than a discharge quantity of the low-pressure pump 12 or a discharge quantity of the high-pressure pump 14 may be restricted not to exceed a predetermined value slightly smaller than a discharge quantity of the low-pressure pump 12.

In the first to third embodiments above, functions executed by the ECU 32, either in part or as a whole, may be realized by hardware as a single or two or more ICs or the like.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A high-pressure pump control device for an internal combustion engine including a high-pressure pump supplied with fuel discharged from a low-pressure pump and an injector supplied with fuel discharged from the high-pressure pump, comprising:

a prediction unit predicting whether a discharge quantity of the high-pressure pump exceeds a discharge quantity of the low-pressure pump;

a restricting unit executing a discharge quantity restriction control to restrict a discharge quantity of the high-pressure pump not to exceed a predetermined value when the prediction unit predicts that a discharge quantity of the high-pressure pump exceeds a discharge quantity of the low-pressure pump; and a fuel pressure acquisition unit acquiring a fuel pressure that is a pressure of the fuel supplied to the injector, wherein:

when the high-pressure pump and the low-pressure pump are operating without abnormality, the prediction unit predicts whether the discharge quantity of the high-pressure pump exceeds the discharge quantity of the low-pressure pump, based on a fuel pressure deviation that is a deviation between the fuel pressure and a target fuel pressure.

2. The high-pressure pump control device for the internal combustion engine according to claim 1, further comprising:

a fuel pressure control unit calculating a feedback control quantity according to a fuel pressure deviation found as a deviation of the fuel pressure acquired by the fuel pressure acquisition unit from the target fuel pressure, and executing a fuel pressure feedback control to correct a discharge quantity of the high-pressure pump using the feedback control quantity, wherein the restricting unit executes the discharge quantity restriction control by restricting the feedback control quantity.

3. The high-pressure pump control device for the internal combustion engine according to claim 2, wherein:

the restricting unit executes the discharge quantity restriction control by restricting the feedback control quantity by restricting a proportional term of the feedback control quantity.

4. The high-pressure pump control device for the internal combustion engine according to claim 2, wherein:

the restricting unit executes the discharge quantity restriction control by restricting the feedback control quantity by restricting the fuel pressure deviation used to calculate the feedback control quantity.

5. The high-pressure pump control device for the internal combustion engine according to claim 2, wherein:

the restricting unit executes the discharge quantity restriction control by restricting the feedback control quantity by restricting the target fuel pressure.

6. The high-pressure pump control device for the internal combustion engine according to claim 1, further comprising:

a proportional-term calculation unit calculating a proportional term based on the fuel pressure deviation; and a proportional-term guard-value calculation unit calculating a proportional term guard value by a map, wherein:

the prediction unit predicts whether the discharge quantity of the high-pressure pump exceeds the discharge quantity of the low-pressure pump, based on the proportional term and the proportional term guard value.

7. The high-pressure pump control device for the internal combustion engine according to claim 1, further comprising:

a fuel-pressure deviation guard-value calculation unit calculating a fuel pressure deviation guard value by a map, wherein:

the prediction unit predicts whether the discharge quantity of the high-pressure pump exceeds the discharge quantity of the low-pressure pump, based on the fuel pressure deviation and the fuel pressure deviation guard value.

8. A high-pressure pump control device for an internal combustion engine including a high-pressure pump supplied with fuel discharged from a low-pressure pump and an injector supplied with fuel discharged from the high-pressure pump, comprising:

a prediction unit predicting whether a discharge quantity of the high-pressure pump exceeds a discharge quantity of the low-pressure pump; and a restricting unit executing a discharge quantity restriction control to restrict a discharge quantity of the high-pressure pump not to exceed a predetermined value when the prediction unit predicts that a discharge quantity of the high-pressure pump exceeds a discharge quantity of the low-pressure pump, wherein:

when the high-pressure pump and the low-pressure pump are operating without abnormality, the prediction unit predicts whether the discharge quantity of the high-pressure pump exceeds the discharge quantity of the low-pressure pump, based on a target fuel pressure.

9. The high-pressure pump control device for the internal combustion engine according to claim 8, further comprising:

a fuel pressure acquisition unit acquiring a fuel pressure that is a pressure of the fuel supplied to the injector; and a target fuel-pressure guard-value calculation unit calculating a target fuel pressure guard value based on the fuel pressure, wherein:

the prediction unit predicts whether the discharge quantity of the high-pressure pump exceeds the discharge quantity of the low-pressure pump, based on the target fuel pressure and the target fuel pressure guard value.

10. The high-pressure pump control device for the internal combustion engine according to claim 8, wherein the predetermined value is the discharge quantity of the low-pressure pump.

11. The high-pressure pump control device for the internal combustion engine according to claim 1, wherein the predetermined value is the discharge quantity of the low-pressure pump.

12. A high-pressure pump control device for an internal combustion engine including a high-pressure pump supplied with fuel discharged from a low-pressure pump and an injector supplied with fuel discharged from the high-pressure pump, comprising:

a fuel pressure sensor configured to detect a fuel pressure that is a pressure of the fuel supplied to the injector;

a controller including a computer processor for executing computer program instructions read from a non-transitory computer-readable storage medium such that control device is at least configured to perform:

a prediction which predicts whether a discharge quantity of the high-pressure pump exceeds a discharge quantity of the low-pressure pump;

a restriction which executes a discharge quantity restriction control to restrict a discharge quantity of the high-pressure pump not to exceed a predetermined value when the prediction predicts that a discharge quantity of the high-pressure pump exceeds a discharge quantity of the low-pressure pump; and abnormality prevention which prevents an abnormality in the high pressure pump when the prediction predicts that the discharge quantity of the high-pressure pump exceeds the discharge quantity of the low-pressure pump, wherein the prediction that predicts that the discharge quantity of the high-pressure pump exceeds the discharge quantity of the low-pressure pump is based on a fuel pressure deviation that is a deviation between the fuel pressure and a target fuel pressure.

* * * * *